US006390644B1

(12) United States Patent
Dolan

(10) Patent No.: US 6,390,644 B1
(45) Date of Patent: May 21, 2002

(54) LAMP DISPLAY SYSTEM

(76) Inventor: Patrick S. Dolan, 1020 SW. Westwood Ct., Portland, OR (US) 97201

( * ) Notice: Subject to any disclaimer, the term of this patent is extended or adjusted under 35 U.S.C. 154(b) by 0 days.

(21) Appl. No.: 09/689,232

(22) Filed: Oct. 11, 2000

Related U.S. Application Data

(63) Continuation-in-part of application No. 09/437,287, filed on Nov. 10, 1999, now Pat. No. 6,280,066.

(51) Int. Cl.[7] ..... F21V 21/14; F21V 21/32

(52) U.S. Cl. ..... 362/250; 362/413; 362/418; 362/147

(58) Field of Search ..... 362/410, 414, 362/418, 430, 413, 250

(56) References Cited

U.S. PATENT DOCUMENTS 5,019,753 A 5/1991 Strauss

FOREIGN PATENT DOCUMENTS

EP 0175660 3/1986

OTHER PUBLICATIONS 7 sheets of copies of photographs.

*Primary Examiner*—Sandra O'Shea
*Assistant Examiner*—Ali Alavi
(74) *Attorney, Agent, or Firm*—Robert L. Harrington

(57) ABSTRACT

A table lamp display system secures a lamp on a tilted shelf or block for display purposes. A coupler is attached to the stub end of a center tube of the lamp. A hollow tube extension of suitable length is inserted through a slot of the shelf or block and is secured to the coupling to secure the lamp to the shelf or block. In another arrangement the lamp is secured to a configured hook that is attached to the shelf.

4 Claims, 7 Drawing Sheets

112
112
116
116
52
50
55

LAMP DISPLAY SYSTEM

This is a continuation in part of U.S. application Ser. No. 09/437,287, filed Nov. 10, 1999 now U.S. Pat. No. 6,280,066 B1.

FIELD OF THE INVENTION

This invention relates to the display of lamps in large retail outlets and more particularly to the securement of such lamps on overhead tilted shelves for optimum display of the lamps.

BACKGROUND OF THE INVENTION

Lamps such as floor lamps and table lamps are commonly purchased for decorative as well as lighting purposes. There are thousands of different lamp designs that are available to a purchaser. A purchaser understands that different lamps will satisfy his or her lighting requirements and it is the decorative appeal that determines selection.

A table lamp is typically placed on a table of some sort and often a wood table. The table places the lamp at a height that is about at eye level when seated but is quite visible from a standing position. Such is also true for floor lamps. The purchaser wants to examine the lamp design as visualized for example on such a table when making his purchase.

Large retail stores or outlets in particular want to maximize the use of display space and overhead shelving is common for displaying items such as lamps. The overhead shelving also places the display out of the reach of customers and avoids the disruption that occurs from customer handling. To enable purchasers to ideally examine merchandise displayed on overhead shelves, the shelves may be tilted. Such is not feasible for table lamps or floor lamps as such lamps are top heavy and tilting of the shelf can result in tipping the lamp off the shelf. Thus, lamps when displayed on overhead shelving are commonly displayed on non-tilted shelves and such is unsatisfactory for examining the lamp's decorative appeal.

BRIEF DESCRIPTION OF THE INVENTION

The provision of visually exposed brackets to secure a lamp to a tilting shelf is generally not considered satisfactory. In the preferred embodiment of the invention, the structure of the lamp itself is utilized for securement to a tilted shelf. Almost all lamps are structured to have a decorative body portion with a socket provided at the top (over which a lamp shade is mounted) and a base portion at the bottom either as part of the body or as a separate component. A tube extends from the base through the body to the socket and it performs a dual function. The tube is threaded at the top and bottom. It is secured at its top to the socket, inserted down through the body and base and then a nut is threaded onto the bottom of the tube to secure the base (if separate), body and socket together. The tube also functions as a conduit for extending an electrical cord from the base to the socket. The cord often projects from within the base out through a hole in the base, the projecting cord end being fitted with an electrical plug that can be connected to an electrical outlet. The bottom of the base is often covered with a felt or similar covering to avoid scratching a table top.

Once the nut is threaded onto the bottom end of the tube, only a short stub of the tube end is exposed. However, it is the stub end of the tube that provides for the mounting of the lamp. The felt cover is removed and the plug is removed from the cord end (e.g., as by cutting). The cord is pulled back into the base and inserted through a coupler and a tube extension (the combination referred to as a coupling). The coupler is provided with female threads to fit the threads of the stub shaft and the tube extension is then threadably secured to the other end of the coupler. A tilted shelf is provided with a hole that receives the tube extension. The inserted end of. the tube extension is then fitted with a fastener, e.g., a nut, that threadably fits the end of the extension. The cord end is inserted down through the coupler, tube extension and nut and fitted with a plug and connected to an electrical outlet under the shelf. A viewer is able to examine the lamp from a side view even though the lamp is sitting on an overhead but tilted shelf and without the distractions of brackets or the like. It will be understood that the under side of the shelf can be covered as desired.

Further to the above, it will be appreciated that the degree of tilt that is desired for the display of the lamps is dependent on the height of the shelf. Large lamp retailers often use high racking in their stores. In most categories of products that they carry in their stores they display the items above the boxed stock directly underneath the displayed items allowing a customer to easily identify and load onto their shopping cart. By displaying the items above and the product underneath, the retailer is best utilizing its high racking and increasing their sales per square foot.

Many such large retailers are using this same display concept for table lamps, floor lamps, desk lamps, novelty lamps and other types of portable lamps. This has worked with mixed results. They gain valuable space but because the lamps are on a standard shelf and the lamps are mounted above eye level, it is nearly impossible to see the lamp base on most types of lamps, not only because it is mounted so high up, you. look straight up into the glare of the light bulb.

Other retailers of lamps sell the lamp bases separately from their lamp shades often referred to as mix/match. Often times they do not light up or display the lamps other than the base by itself. This saves shelf space but does not satisfy many customers because they want to see the lamp lighted up. Also, many customers don't have a good feel for what type of shade looks best. There are many different types of fabrics used in lamp shades and they can look quite different when lighted.

Until now retailers have had two choices. Display lamps overhead inadequately or save space by just setting lamp bases on a shelf without a shade to save space.

With the angled lamp display of the present invention, a customer can look above and by having the lamps tilted at an angle that allows customers to view lamps on the display above straight on as if they were sitting on their couch looking at the lamp. They can see the whole lamp including the base and they are not looking up into the lamp shade. The lamps on display may vary from approximately 30–60 degrees, the higher they are the steeper the angle that they would be displayed at.

For such a large display of lamps it may be desirable to display the lamps on different tiers of shelves. A viewer looking upwardly at one lamp and then looking at a lamp on a higher or lower shelf will be seeing the two lamps at a different angle if the shelves (and thus the lamps) are similarly tilted.

Accordingly, a further feature of the invention is the provision of a support base for the lamp which is devised to have a desired angle when rested on a flat shelf at a particular height. A second support base will have a different angle for a different height so as to achieve the same view of a lamp positioned at the different tier heights. There may be third and fourth or more different support bases so that a plurality of shelves at different heights can all be provided with the same viewing angle.

A still further feature is the provision of a pre-prepared lamp display that is readily secured to a shelf or display bracket without having to cut off the plug end. During assembly of the lamp and prior to threading the elastic cord through the lamp base, a wing nut, oblong washer and a coupler are threaded onto the cord. Thus, the lamp when shipped to the retailer includes the nut, coupler and washer. The coupler may or may not be screwed onto the threaded tube portion projected below the lamp base. An angled bracket or shelf is provided with a hole that is configured to allow the plug in, wing nut and washer to be inserted through the hole. The coupler being threaded to the tube is extended down through the hole, the washer is positioned to abut the shelf bottom and the nut is tightened against the washer.

The several facets of the invention will be more fully understood and appreciated upon reference to the following detailed description having reference to the accompanying drawings.

DESCRIPTION OF THE PREFERRED EMBODIMENT

Figure 1:
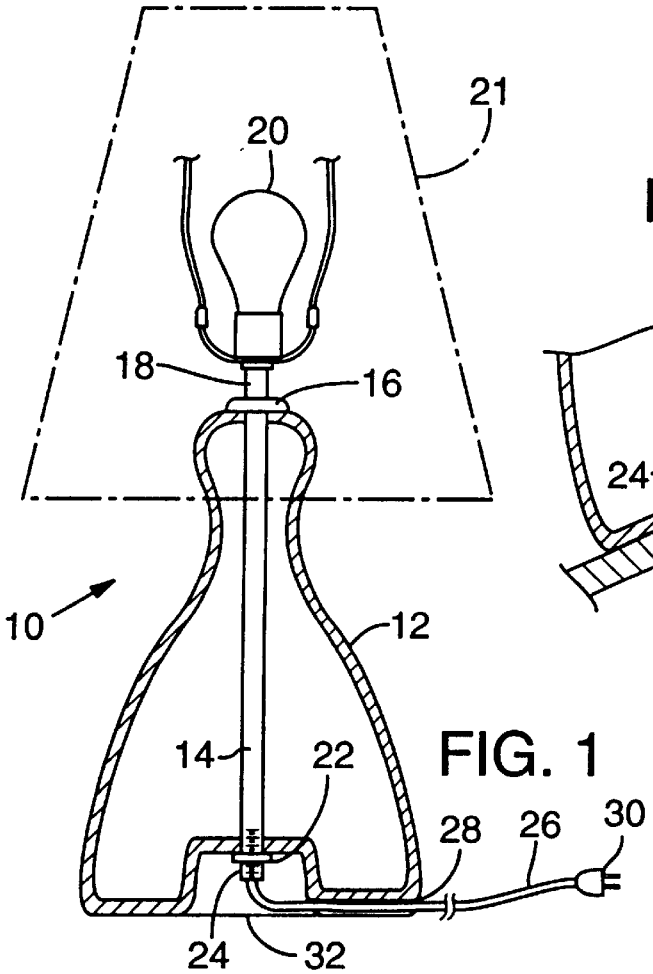
FIG. 1 is a view of a lamp assembly.

FIG. 1 illustrates a typical lamp assembly 10. The lamp assembly 10 has a body portion 12, that is most often of an artistic or appealing shape. A threaded tube 14 is installed in the body portion 12 and is secured by a nut 16. Mounted on the threaded tube 14 at the top of the body portion 12 is a lamp socket assembly 18. The lamp socket assembly 18 receives a bulb 20 and also provides support for a shade 21. The threaded tube 14 is secured at the lower end of the body portion 12 (the base portion) by another nut 22. A stub end 24 of the tube 14 extends beyond the nut 22. An electrical wire 26 is extended from the lamp socket 18 down through the tube 14 and extends through an aperture 28 in the base portion of the body portion 12. The electrical wire 26 has a standard plug 30 which is insertable into a standard outlet to supply power to the lamp assembly 10. Typically a pad 32, such as felt, is attached to the bottom of the body portion 12 to protect the surface upon which the lamp assembly 10 will be placed. The above describes a typical lamp assembly 10, however it will be appreciated that there are many variations in design and configuration.

The object of the present invention is to provide means for mounting the lamp assembly 10 on a tilted display shelf without the possibility of the lamp being subject to tipping or toppling off the shelf. In the preferred embodiment, the structure of the lamp assembly 10 is utilized to provide a secure mount of the lamp assembly 10 to a tilted shelf.

Figure 3:
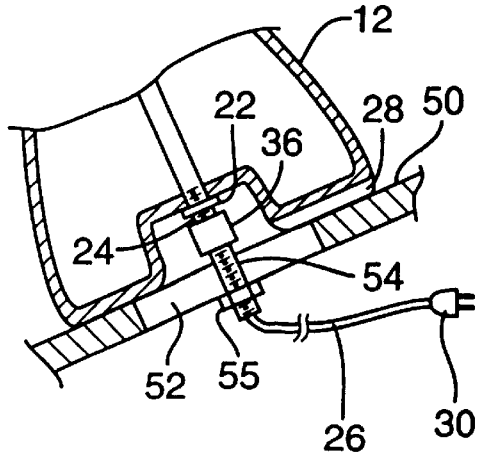
FIG. 3 is a sectional view showing the lamp assembly of FIG. 1 mounted to a tilted shelf.
Figure 2:
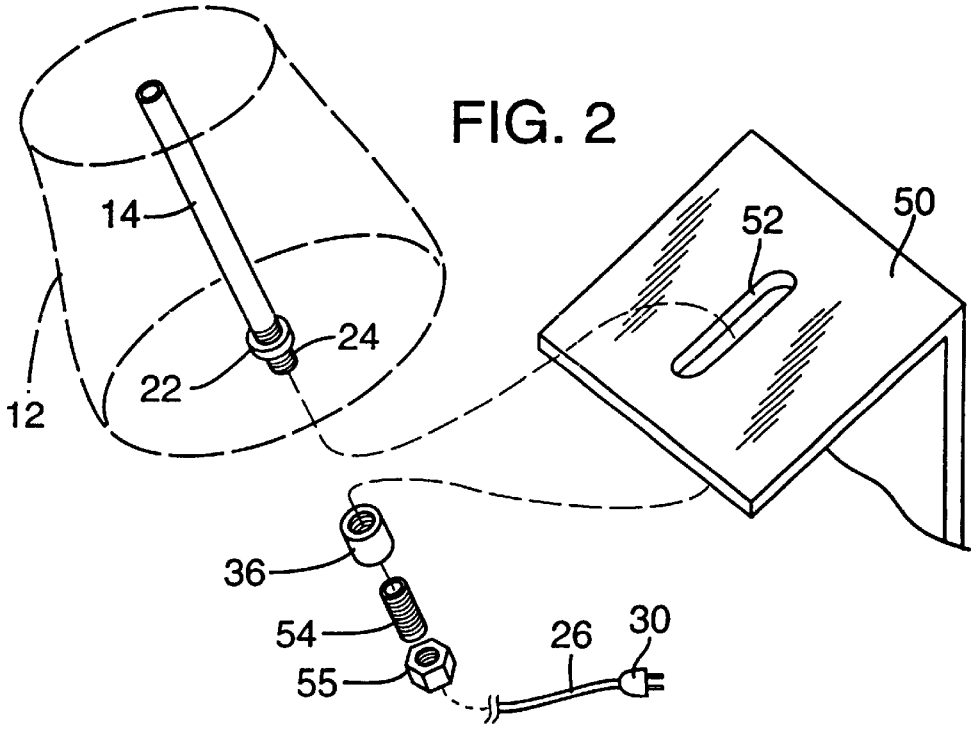
FIG. 2 is a partial exploded view of the lamp assembly of FIG. 1 and a portion of a tilting shelf.

The lamp assembly 10 is secured to a tilted shelf 50 as shown in FIGS. 2 and 3. The plug 30 is cut off from the wire 26. The pad 32 is removed from the base of the body portion 12 to expose the stub end 24 of the tube 14. The wire 26 is withdrawn through the aperture 28 and the wire 26 extends from the end of the tube 14. A coupler 36 is slid over the wire 26 and is threadably installed on the stub end 24 of the tube 14. An extension tube 54 is slid over the wire 26 and is threadably installed in the coupler 36.

Figure 4:
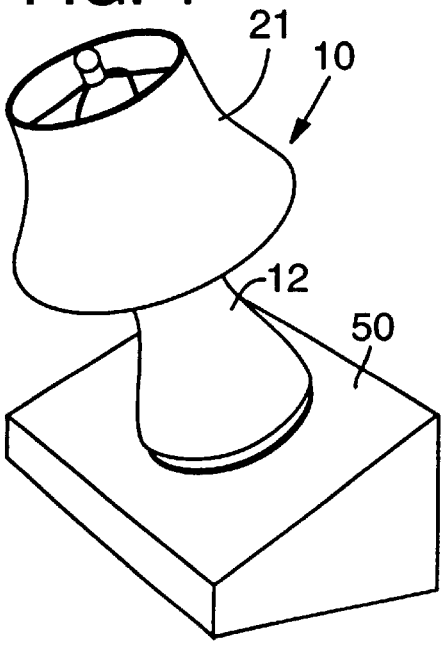
FIG. 4 is another view of the lamp assembly of FIG. 1 mounted to a shelf.

FIGS. 3 and 4 illustrate the lamp assembly 10 mounted on a tilted shelf 50. The shelf 50 has a slot opening 52 that is aligned with and receives the extension tube 54. The tube 54 is of sufficient length to extend through the thickness of the shelf 50. A nut 55 is mounted on the tube 54 to secure the lamp 10 to the shelf 50 in a tilted position. A new plug 30 is installed on the end of the extending wire 26.

Figure 5:
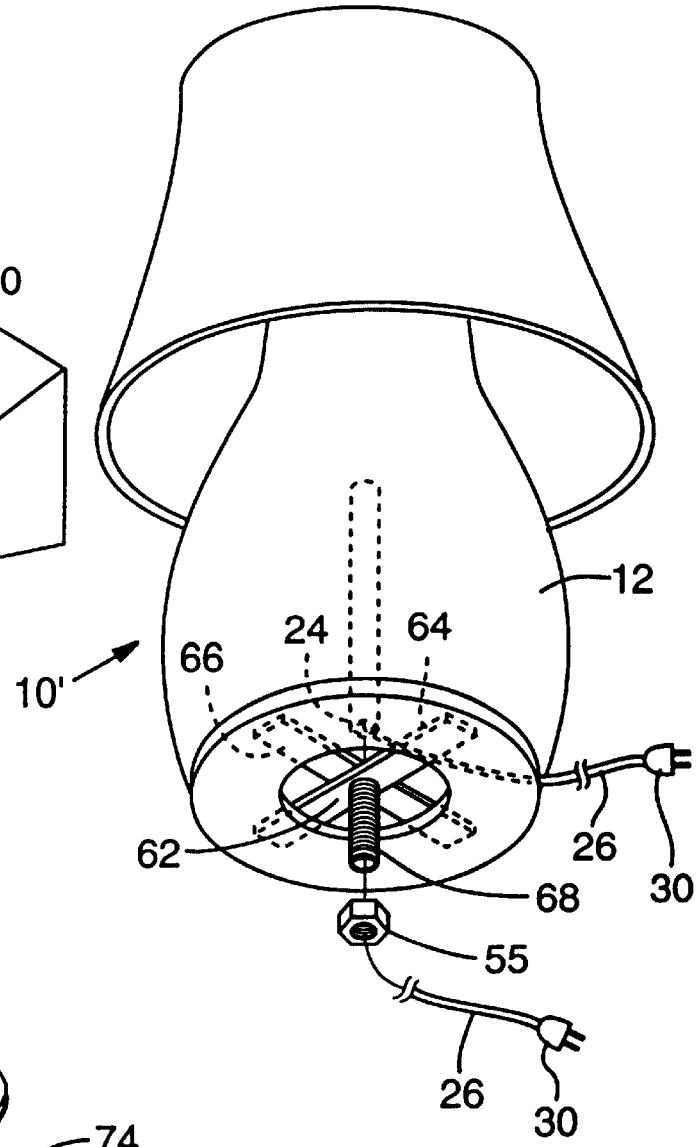
FIG. 5 is a view illustrating another mounting arrangement for a lamp.

FIG. 5 illustrates another manner of mounting a lamp 10' on a shelf 50. In this embodiment the body 12 of the lamp 10 has an enlarged opening 60 in its base. The wire 26 extends from the socket down through the body 12 loosely as illustrated. A cross member 62 is insertable into the opening 60 and will engage the edges of the opening 60. The cross member 62 has two legs 64, 66 that are threadably installed on a tube member 68 that extends below the base. The legs 64, 66 are rotated on the tube member 68 so that they overlap one another permitting the cross member to be inserted into the base of the lamp. When inserted in the base of the lamp, the legs 64, 66 are rotated so that they are normal to each other. The lamp 10' is installed on the shelf 50 with the tube 68 extending through the shelf 50 and is secured by the nut 55 to retain the lamp 10' on the shelf 50. With this arrangement the wire 26 does not have to be removed from its normal position, or if preferred it can be threaded down through tube member 68 as also shown.

There are occasions where a lamp is displayed on a horizontal shelf but it is desired to tilt the lamp for display purposes. A mounting block 70 shown in FIG. 6 has an inclined surface 72 at the desired display angle. A slot 74 is provided in the surface 72 to facilitate mounting the lamp 10 to the mounting block 70 in the same manner as the lamp 10 is mounted to the shelf 50 as shown in FIGS. 3 and 4. The mounting block 70 is then placed on a horizontal shelf 76 at a desired position.

Figure 7:
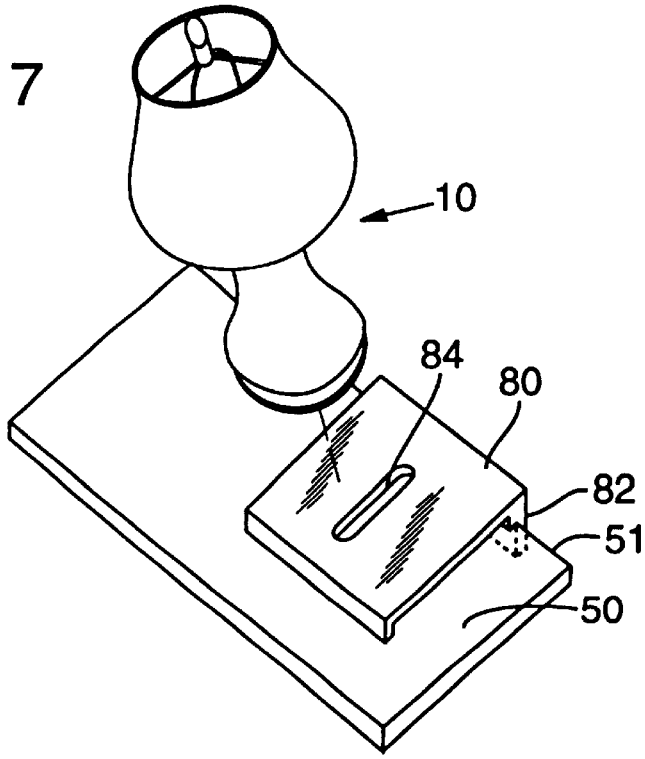
FIG. 7 is a view of a mounting bracket for mounting a lamp to a tilted shelf.

Another arrangement for mounting a lamp 10 in tilted attitude is the use of a mounting brace 80 shown in FIG. 7 that is mountable at any position on the tilted shelf 50. The brace 80 has an extending lip 82 that engages the edge 51 of the shelf 50 to secure the brace 80 to the shelf 50. The brace 80 has a slot 84 to facilitate mounting the lamp 10 to the brace 80 in the same manner as shown in FIGS. 3 and 4. The reader will appreciate that whereas the openings shown are in the form of slots, the openings can be any configuration (round, square, etc.) Which will receive the bracket and provide attachment thereof to the support surface.

Figure 8:
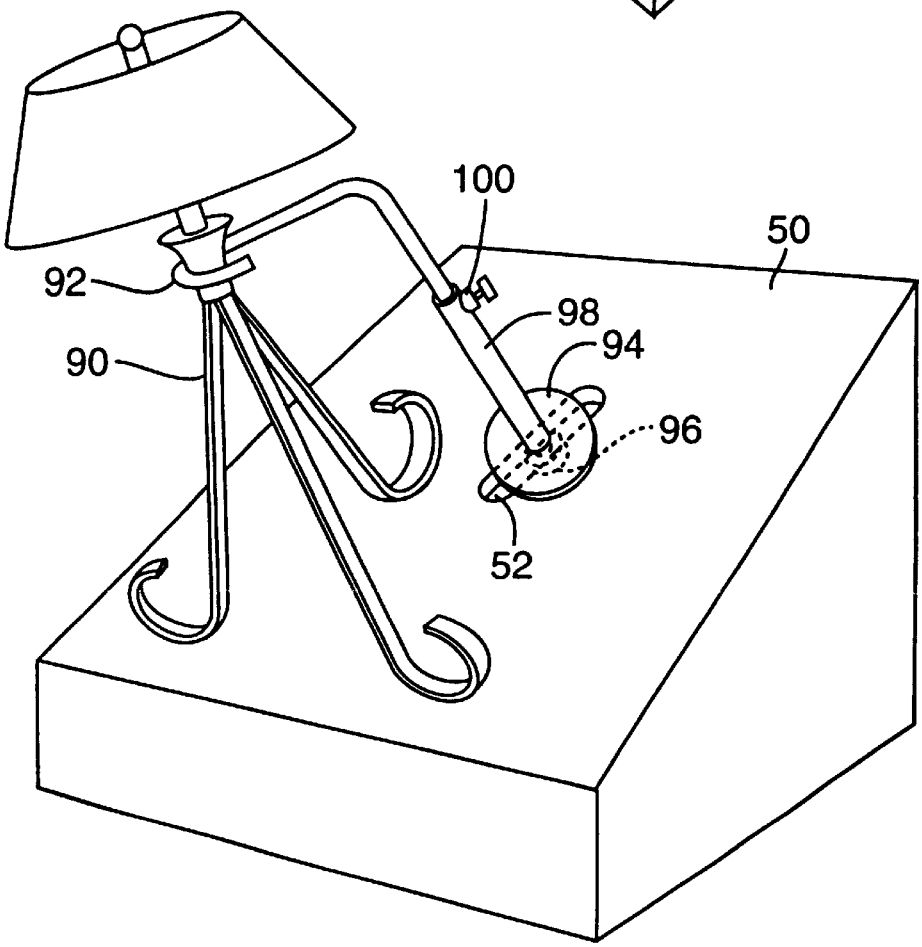
FIG. 8 is a view of another mounting arrangement for mounting the lamp in a tilted attitude.

Some lamps have different configurations and don't lend themselves to be mounted in the manner described. A lamp 90, for example as shown in FIG. 8, is of the type that does not have a center tube 14 extending from the socket assembly 18. To secure the lamp 90 to a tilted shelf 50 (or mounting brace 80) a hook 92 is mounted in the slot 52 of the shelf 50. The hook 92 has a top flange 94 that engages the top surface of the shelf 50 and is secured by a nut 96. The hook is adapted to encircle the top of the lamp 90 to secure the lamp in the tilted position. The hook 92 is adjustably mounted in a tube 98 that extends from the flange 94. The hook 92 is held in position by a lock mechanism 100.

Figure 6:
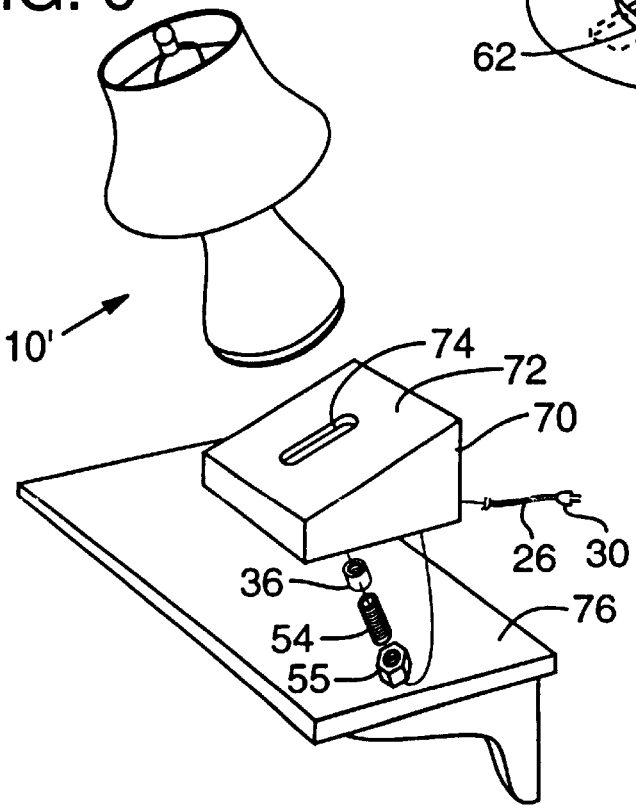
FIG. 6. is a view of a mounting block for mounting a lamp in a tilted attitude on a horizontal shelf.
Figure 9:
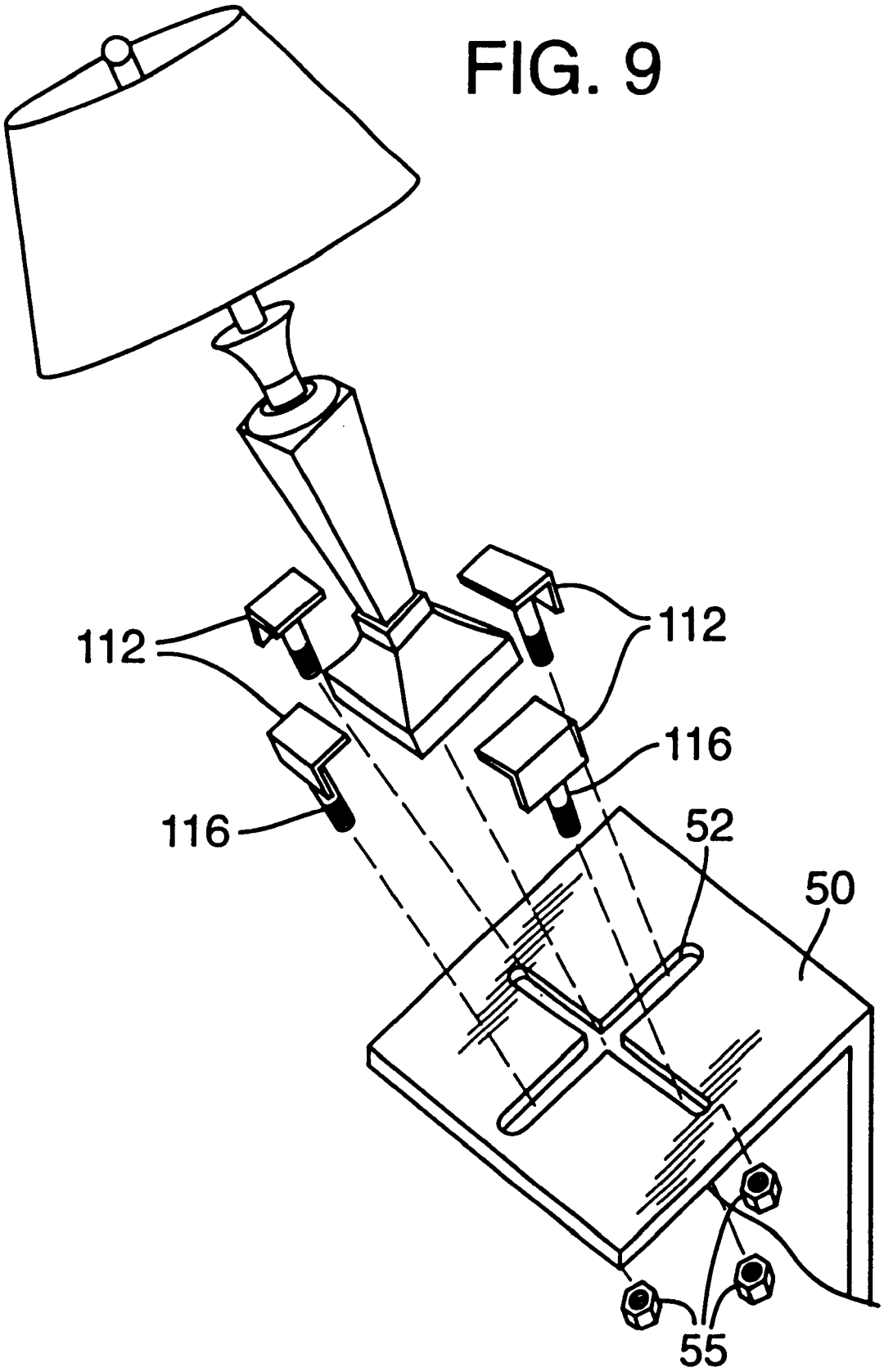
FIG. 9 is a view of another mounting arrangement for mounting the lamp in a tilted attitude.

FIG. 9 illustrates another example of securing a lamp 110 to the tilted shelf 50. Brackets 112 configured to engage the base 114 of the lamp 110 are fitted in the slot 52 of the shelf 50. The brackets 112 have a threaded stud 116 that extends through the slot 52. A nut 55 is fitted on the stud 116 to secure the lamp 110 to the shelf 50. It will be appreciated that the brackets 112 may be used with the block 70 as shown in FIG. 6 to secure the lamp 110 to the block 70.

Figure 10:
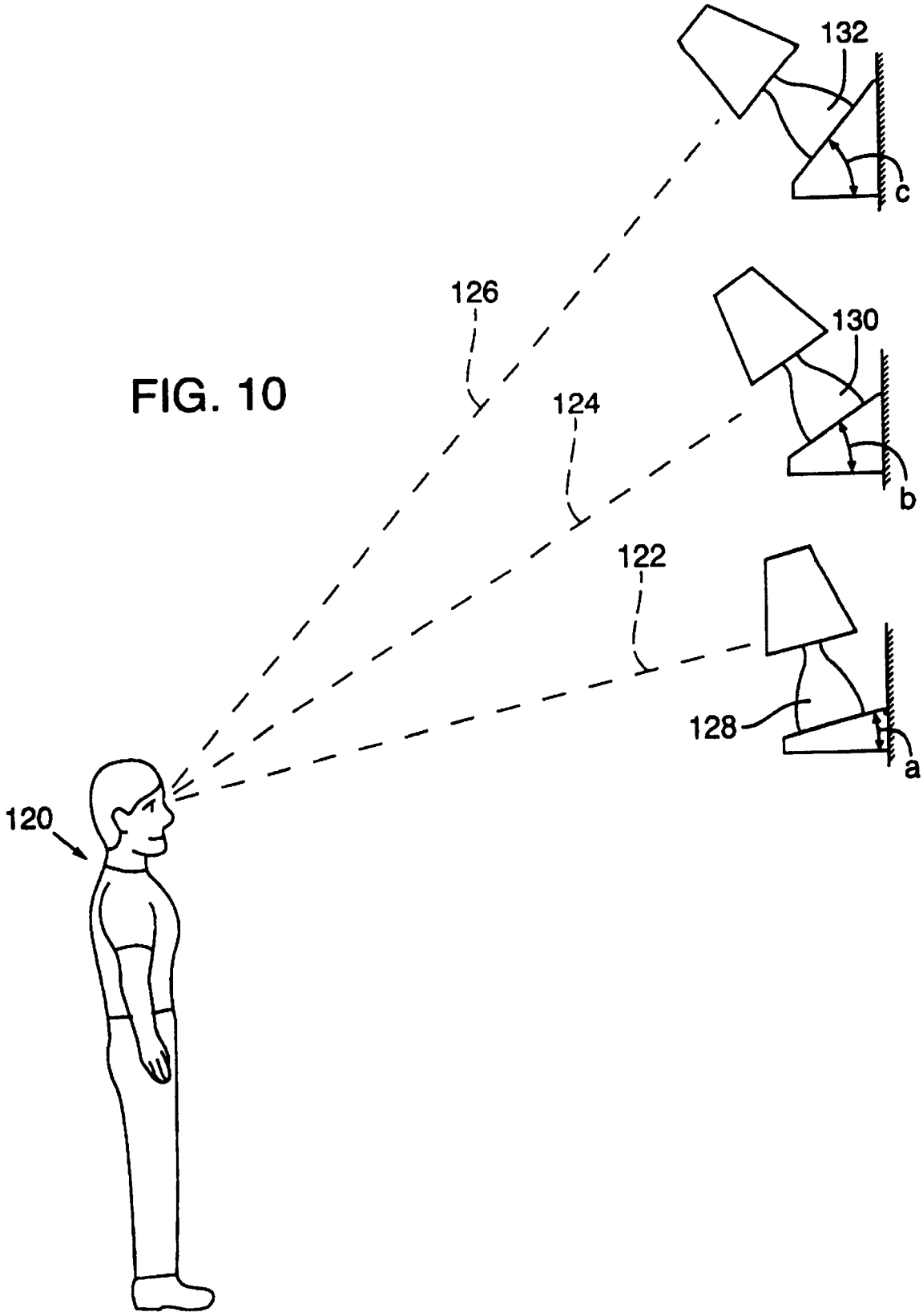
FIG. 10 is a view of a still further embodiment where specialty shelving is provided to display lamps at different heights having correspondingly different angles of display.
Figure 11:
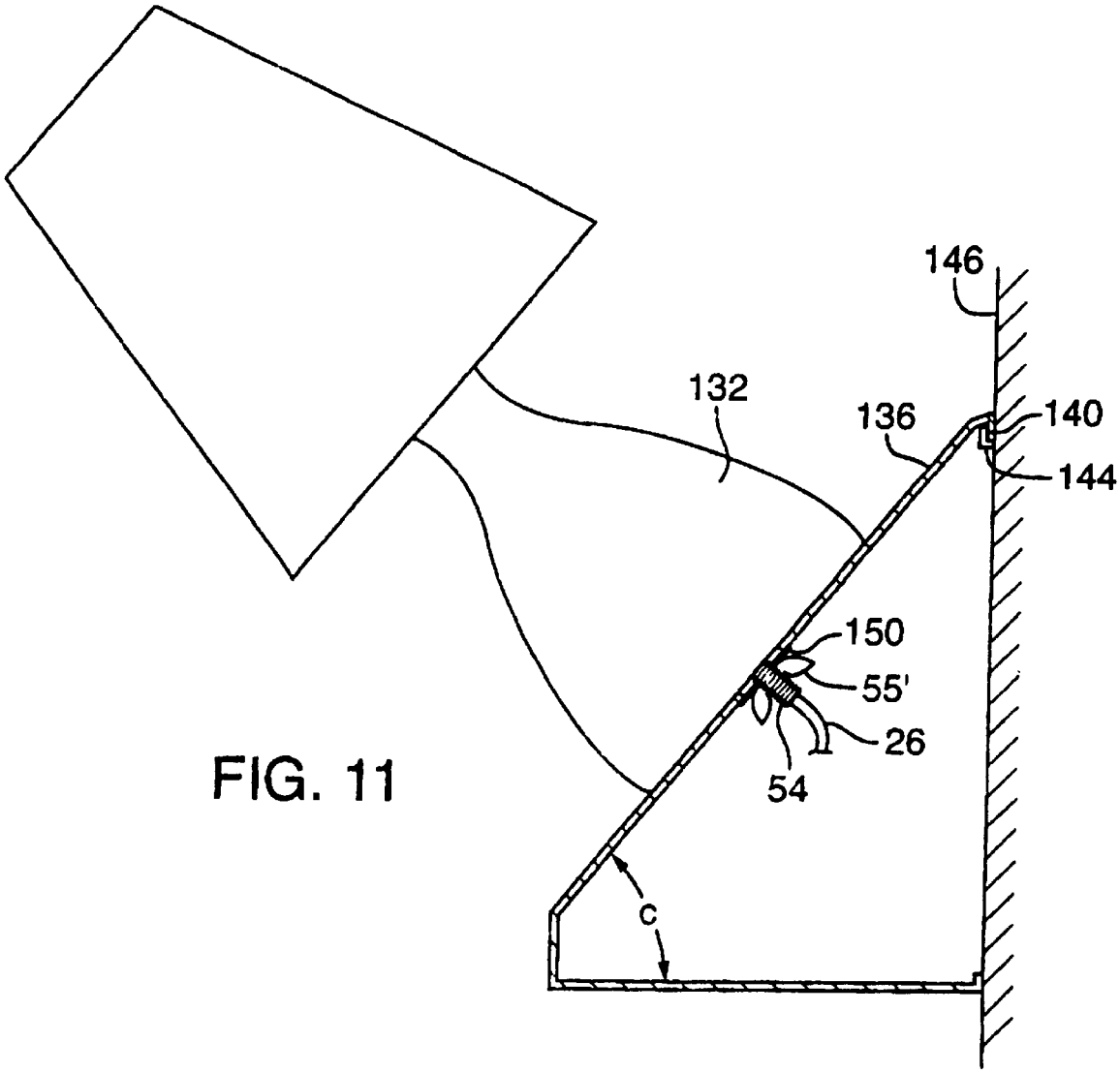
FIG. 11 is an enlarged side view of shelving as illustrated in FIG. 10.
Figure 12:
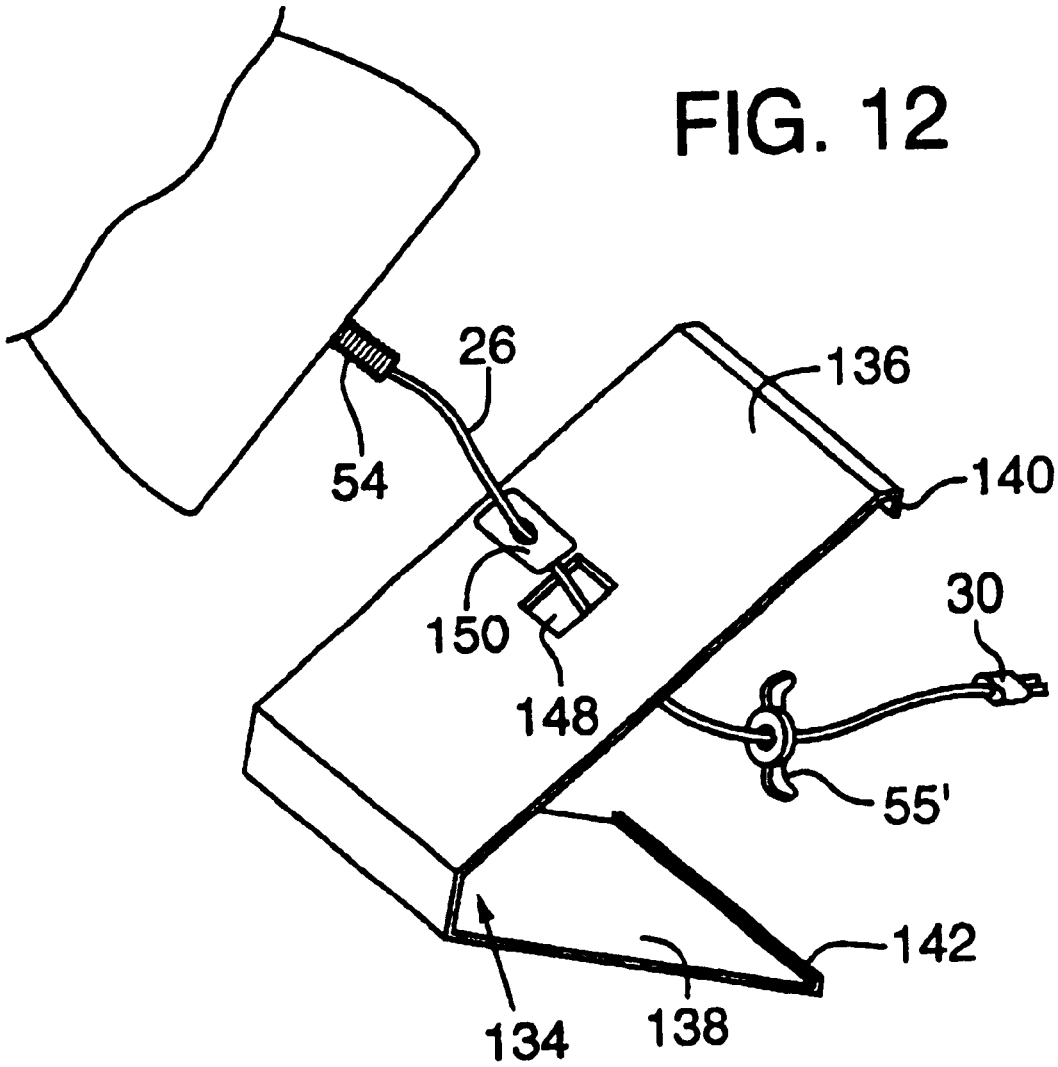
FIG. 12 is a perspective view of the shelving of FIGS. 10 and 11 illustrating a lamp being affixed thereto.

FIGS. 10–12 disclose a concept for displaying multiple tiers of lamps. FIG. 10 illustrates a customer/viewer 120 viewing an overhead display of lamps at different tiers or heights. As will be appreciated from the drawing, view line 122 is at a relatively shallow angle as compared to view line 124 which in turn is more shallow than view line 126. If the viewer is going to see these lamps from the same side view, the lamp 128 at the lower tier has to be tilted at one angle a to place the lamp 128 perpendicular to view line 122, the lamp 130 at a second angle b and lamp 132 at a third angle c.

FIGS. 10–12 provide these varying tilt angles using support brackets 134 best seen in FIG. 12. The bracket 134 is formed metal sheeting having upper and lower legs 136, 138 which have inturned upper and lower ends or lips 140, 142. The legs 136, 138 are formed to the desired angle (e.g., angles a, b or c). The inturned lip 140 is secured to a J hook 144 (i.e., having an upturned lip) that is attached to the wall 146 at the desired height as illustrated in FIG. 11.

With reference to FIG. 12, also shown is a system for securing the lamp to a shelf or bracket 134 without the need to remove the plug in 30. When the lamp is assembled and before wire 26 is inserted through the tube 14, a coupler 54, a nut 55 and washer 150 are threaded onto the wire 26. The bracket 134 is provided with a hole 148 that is configured, e.g., rectangularly. The washer 150 is cooperatively configured so that it can be turned sideways as illustrated and inserted through the opening 148. With the washer inserted through the opening, the coupler 54 at the threaded end of tube 14 (see FIG. 2) is inserted through the opening until the base of the lamp engages leg 136 of bracket 134. (See FIG. 11) The washer 150 is then positioned crossways to the hole 148 and the nut 55' is screwed onto the threaded end of the coupler to be abutted against the washer and the bottom of the shelf (leg 136).

Alternatively, the shelving can be provided as shown in FIG. 6 wherein the mounting block 70 is configured to have different display angles, e.g., angles a, b and c. In either of these examples a viewer 120 can make a fair comparison of the lamps 128, 130, 132 in that he/she has the same side view due to the angles a, b and c being established to accommodate the height difference as between the shelves.

The different embodiments shown are but a few of the ways that a lamp can be secured to a tilted shelf. Other means for achieving such securement can include for example an anchor screwed into the shelf or wall behind the shelf and a thin wire extended from the lamp near or at the socket and secured to the anchor. The lamp base may be receptive to the use of an adhesive and glued to the shelf. Velcro type fasteners may be applied and so on. Preferably the means used for securement is substantially not visible so that a customer can visualize the total design and only the design of the lamp.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A lamp display comprising:

a determined position of visual observation;

multiple tiers of shelving placed at different heights and presenting different lines of viewing as between the determined position and the multiple tiers of shelving;

each tier of shelving having a determined angle of tilt that places similar lamps on the different shelves in a corresponding visual position as relates to a person viewing the lamps from said position of visual observation.

2. A lamp display as defined in claim 1 wherein the shelving is comprised of a formed sheet material having an inturned upper edge fitted to an upturned lip provided on a display wall.

3. A lamp display as defined in claim 1 wherein the shelving is comprised of horizontal surfaces, and angled mounting blocks are provided on the horizontal surfaces, the different tiers having different angles of tilt provided by different angles of the mounting blocks.

4. A method of securing a display lamp to the upper surface of an angled shelf which comprises:

preparing a lamp with a pre-assembled mounting tube having a threaded end and an electrical cord extended from a light fixture of the lamp at one end of the cord and through the tube to a base of the lamp where it is extended out of the tube, the plug in provided on the opposite end of the cord and a coupler, washer and nut threaded onto the cord between the base and the plug in;

providing an angled shelf and an opening there through, said opening and said washer cooperatively configured to permit passage of the washer through the opening upon a first orientation relative to the opening and restricting passage of the washer through the opening upon a second orientation of the washer relative to the opening, said opening sufficiently large to permit passage of the nut and plug in end;

coupling the coupler to the threaded end of the tube, inserting the plug in end and sequentially the nut and washer through the opening from the upper surface of the shelf, and feeding the cord through the opening so as to abut the lamp base against the upper surface to insert the coupler through the opening to be protruded to the bottom side of the shelf;

orienting the washer relative to the opening to prevent passage of the washer back through the opening, threading the nut onto the threaded end of the coupler to thereby cinch the washer against the bottom side of the shelf.

* * * * *